US005260254A

United States Patent [19]

Hotta et al.

[11] Patent Number: 5,260,254

[45] Date of Patent: * Nov. 9, 1993

[54] INFORMATION MEMORY AND DISPLAY MEDIUM

[75] Inventors: Yoshihiko Hotta, Mishima; Toru Nogiwa, Numazu, both of Japan

[73] Assignee: Ricoh Company, Ltd., Tokyo, Japan

[ * ] Notice: The portion of the term of this patent subsequent to Feb. 11, 2009 has been disclaimed.

[21] Appl. No.: 538,426

[22] Filed: Jun. 15, 1990

[30] Foreign Application Priority Data

Jun. 20, 1989 [JP] Japan ..... 1-157189
Jul. 14, 1989 [JP] Japan ..... 1-181766
Jan. 19, 1990 [JP] Japan ..... 2-9786

[51] Int. Cl.[5] ..... B41M 5/30; B41M 5/40

[52] U.S. Cl. ..... 503/217; 428/694; 503/201; 503/208; 503/209; 503/225; 503/226

[58] Field of Search ..... 428/694; 503/200, 217, 503/226, 201, 208, 209, 225; 427/152

[56] References Cited

FOREIGN PATENT DOCUMENTS 59-199284 11/1984 Japan .
60-18388 1/1985 Japan .

*Primary Examiner*—B. Hamilton Hess
*Attorney, Agent, or Firm*—Oblon, Spivak, McClelland, Maier & Neustadt

[57] ABSTRACT

An information memory and display medium comprising: (a) a support, (b) a magnetic recording layer formed on the support, (c) a thermosensitive recording layer formed on the magnetic recording layer, which comprises (i) a light reflection layer formed on the magnetic recording layer, and (ii) a reversible thermosensitive recording layer formed on the light reflection layer, comprising a matrix resin, and one or more organic low-molecular-weight compounds dispersed in the matrix resin, with the transparency thereof being reversibly changeable between a transparent state and an opaque state depending upon the temperature thereof, thereby capable of yielding thermally erasable images. The thermosensitive recording layer may further comprise a smoothing layer between the magnetic recording layer and the light reflection layer, and/or an overcoat layer on the reversible thermosensitive recording layer.

9 Claims, 2 Drawing Sheets

4

INFORMATION MEMORY AND DISPLAY MEDIUM

BACKGROUND OF THE INVENTION

1. Field of the Invention

This invention relates to an information memory and display medium, and more particulary to an information memory and display medium capable of storing information in its magnetic recording layer, displaying the stored information in its reversible thermosensitive recording layer, and erasing the displayed information.

2. Discussion of Background

A "prepaid card" is now enjoying tremendous popularity, which is used instead of cash or token coins, for instance, for a public telephone and an automatic ticket vending apparatus for bus, train or subway.

In such a prepaid card, information regarding the spendable sum is recorded therein in advance. The card is punched when it is used in accordance with the amount spent, and a user can roughly know the balance by the punched hole in combination with figures previously printed on the surface of the card.

In order to precisely know the balance, a prepaid card which can display on its surface the balance in figures has been devised. Such a card comprises a thermosensitive recording layer containing a leuco dye or a thermosensitive recording layer prepared by depositing Sn on a magnetic recording layer, as disclosed in Japanese Laid-Open Patent Applications 59-199284 and 60-18388, and the figures for the balance are displayed on its surface when heat is applied thereto by a thermal head. The prepaid card of this type, however, has a shortcoming in that once displayed images cannot be erased.

In order to eliminate the above shortcoming, the inventors of the present invention have proposed an information memory and display medium comprising a thermosensitive recording layer of which transparency is reversibly changeable depending upon its temperature. Owing to such properties of the thermosensitive recording layer, images once recorded therein can be erased. In this medium, the memory function is resided on one surface of the medium and the display function, on the other surface. Therefore, when such a medium is used as a prepaid card, the card has no extra surface usable for advertisement or the like.

SUMMARY OF THE INVENTION

Accordingly, an object of the present invention is to provide an information memory and display medium free from the above drawbacks in the prior art, comprising a display layer overlaid on a magnetic recording layer.

Another object of the present invention is to provide an information memory and display medium in which recorded information can be accurately displayed in a display layer with high contrast, and the displayed information can be erased.

The above objects of the present invention can be attained by an information memory and display medium comprising: (a) a support, (b) a magnetic recording layer formed on the support, (c) a thermosensitive recording layer formed on the magnetic recording layer, which comprises (i) a light reflection layer formed on the magnetic recording layer, and (ii) a reversible thermosensitive recording layer formed on the light reflection layer, comprising a matrix resin, and one or more organic low-molecular-weight compounds dispersed in the matrix resin, with the transparency thereof being reversibly changeable between a transparent state and an opaque state depending upon the temperature thereof, thereby capable of yielding thermally erasable images.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
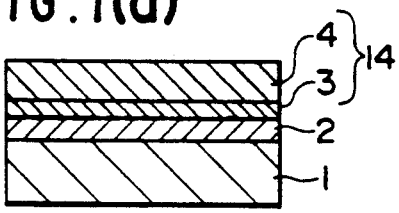
FIGS. 1(*a*), 1(*b*) and 1(*c*) are cross-sectional views of embodiments of an information memory and display medium according to the present invention.

The inventors of the present invention made studies on the improvement of the information memory and display medium described in the "Discussion of Background", and found that information can be accurately recorded in a magnetic recording layer, which serves as a memory layer, and the recorded information can be displayed with an improved contrast in a reversible thermosensitive recording layer, which serves as a display layer, when the thickness of a thermosensitive recording layer to be provided on the magnetic recording layer, and that of the reversible thermosensitive recording layer contained in the thermosensitive recording layer are respectively in a specific range, and that the contrast between the density of the displayed images and that of the background can be greatly enhanced when a light reflection layer is interposed between the magnetic recording layer and the reversible thermosensitive recording layer. The present invention has been accomplished based on the above findings.

Referring now to the accompanying drawings, wherein like reference numerals designate identical or corresponding parts throughout the several views, the present invention is explained in greater detail.

Figure 1C:
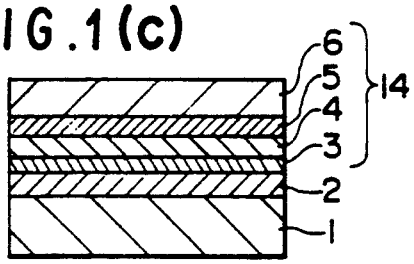
Figure 1B:
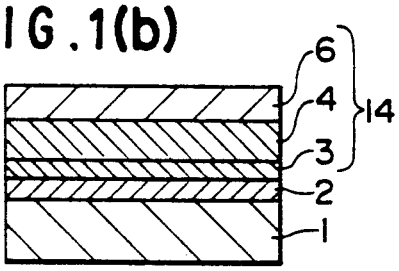

FIGS. 1(*a*), 1(*b*) and 1(*c*) are the cross-sectional views of typical embodiments of an information memory and display medium according to the present invention. FIG. 1(*a*) shows an embodiment of the medium in which a magnetic recording layer 2, a light reflection layer 3 and a reversible thermosensitive recording layer 4 are succesively overlaid, in this order, on a substrate 1; FIG. 1(*b*) shows an embodiment of the medium in which an overcoat layer 6 is further provided on the reversible thermosensitive recording layer 4 of the medium shown in FIG. 1(*a*); and FIG. 1(*c*) shows an embodiment of the medium in which an intermediate layer 5 is further interposed between the reversible thermosensitive recording layer 4 and the overcoat layer 6 of the medium shown in FIG. 1(*b*).

In the present invention, the light reflection layer 3, the reversible thermosensitive recording layer 4, the intermediate layer 5, the overcoat layer 6, and a smoothing layer 7 which will be explained later are collectively referred to as a thermosensitive recording layer 14.

The thickness of the thermosensitive recording layer 14 to be formed on the magnetic recording layer 2 affects the so-called spacing loss of the magnetic recording layer 2. In the present invention, the spacing loss of the magnetic recording layer 2 is obtained as follows:

Sample A of an information memory and display medium comprising the support 1, the magnetic recording layer 2, and the thermosensitive recording layer 14 is prepared. As a reference sample, Sample B is prepared which comprises the support 1 and the magnetic recording layer 2, which are exactly the same as those employed in Sample A.

A magnetic information is recorded in the magnetic recording layer 2 of each of Sample A and Sample B under the same conditions, with a magnetic recording head set with the same intensity of magnetic field for recording and at the same distance from the surface of the magnetic recording layer 2. Then the magnetic field intensity of each recorded information is measured in terms of output voltage by use of an oscilloscope, and the spacing loss is obtained as the ratio of the output voltage of Sample A to the output voltage of Sample B in terms of percentage (%). Thus in the present invention, the spacing loss is defined as the ratio of (a) the magnetic field intensity of a magnetically recorded information in the magnetic recording layer 2 at a predetermined distance from the surface of the magnetic recording layer 2 when the thermosensitive recording layer 14 is provided on the magnetic recording layer 2 to (b) the magnetic field intensity at the same distance from the surface of the same magnetic recording layer 2 as mentioned above when the thermosensitive recording layer 14 is not provided on the magnetic recording layer 2 which ratio is measured in terms of ouput voltage by use of an oscilloscope and obtained in terms of percentage (%).

Namely, when the thickness of the thermosensitive recording layer 14 is thick, the spacing loss is large, and the above percentage is small, and when thin, the spacing loss is small, and the above percentage is large. In practice, it is preferable that the thermosensitive recording layer 14 have a thickness ranging from more than 2 μm to not more than approximately 15 μm.

Furthermore, in order to display images in the reversible thermosensitive recording layer 4 with high contrast, it is preferable that the reversible thermosensitive recording layer 4 have a thickness ranging from 2 μm to less than 15 μm, more preferably from 2 μm to 10 μm, most preferably from 4 μm to 7 μm.

In the case where the reversible thermosensitive recording layer 4 is directly formed on the magnetic recording layer 2, images cannot be displayed therein with high contrast. However, when the light reflection layer 3 is interposed between the reversible thermosensitive recording layer 4 and the magnetic recording layer 2, images can be displayed with high contrast even when the reversible thermosensitive recording layer 4 is thin. This is because light passed through the reversible thermosensitive recording layer 4 is reflected at the light reflection layer 3, so that the apparent opaqueness of the reversible thermosensitive recording layer is enhanced by the reflected light. Thus, images can be displayed in the reversible thermosensitive recording layer with high contrast.

As described above, the information memory and display medium of the present invention utilizes the change in the transparency of the reversible thermosensitive recording layer 4 which comprises a matrix resin and one or more orgnic low-molecular-weight compounds dispersed therein.

In the case where the reversible thermosensitive recording layer 4 is in a transparent state, the particle size of the organic low-molecular-weight compound dispersed in the matrix resin is considered to be relatively large, so that light entered from one side of the layer can transmit to the other side without scattering.

On the other hand, when the reversible thermosensitive recording layer 4 is in a white opaque state, the organic low-molecular-weight compound is considered to exist in the layer as a mass of fine crystals with their crystallographic axes facing various directions. Since light entered from one side of the layer is refracted many times at the interface of the crystals, the reversible thermosensitive recording layer is seemed opaque or white in color.

Figure 5:
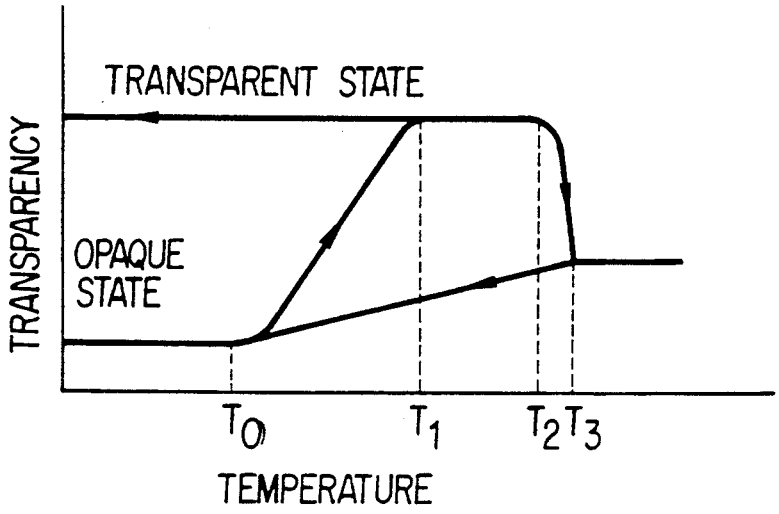
FIG. 5 is a graph showing the relationship between the temperature and the transparency of a reversible thermosensitive recording layer.

FIG. 5 is a graph showing how the transparency of the reversible thermosensitive recording layer is changed depending upon the temperature thereof. As shown in this figure, when the reversible thermosensitive recording layer is initially in a white opaque state at room temperature $T_0$ or below, this opaque state will be referred to as a maximum opaque state. When the layer is heated to temperature $T_1$, it becomes transparent. This transparent state is maintained even if the temperature is further heated to temperature $T_2$. Thus, the layer reaches a maximum transparent state at temperature $T_1$, and the maximum transparent state is maintained until the temperature of the layer reaches $T_2$. Even if the layer in the maximum transparent state is cooled to room temperature $T_0$ or below, the maximum transparent state is kept unchanged. It is considered that this is because the organic low-molecular-weight compound changes its state from a polycrystalline state to a single crystalline state via a semi-melted state during the above-mentioned heating and cooling steps.

When the layer in the maximum transparent state is further heated to temperature $T_3$, it reaches a semitransparent state which is between the maximum transparent state and the maximum opaque state. When the layer in the semitransparent state is cooled to the room temperature $T_0$ or below, it truns to the original maximum opaque state without going through a transparent state. It is considered that this is because the organic low-molecular-weight compound is melted when heated to temperature $T_3$ or above, and recrystallized to yield polycrystals when cooled to temperature $T_0$ or below. If the layer in the white opaque state is heated to temperature between $T_0$ and $T_1$ and then cooled to a temperature lower than $T_0$, the layer reaches an intermediate semitransparent state between the transparent and the white opaque states.

When the layer in the transparent state at room temperature $T_0$ is again heated to temperature $T_3$ or above, and then cooled to room temperature $T_0$, the layer returns to the maximum white opaque state. Thus, the reversible thermosensitive recording layer can take a white maximum opaque state, a miximum transparent state, and an intermediate semistransparent state between the aforementioned two states at room temperature.

Therefore, by selectively heating the layer, white opaque images can be formed in the layer in a transparent state, and transparent images can be formed in the layer in an opaque state. The images formed in the layer can be erased with application of heat. Such formation and erasion of images in the layer can be reversely repeated as desired.

The information memory and display medium as shown in FIG. 1(*a*) can be prepared by the following method:

A transparent or white opaque plastic film such as a polyester film or a sheet of paper is used as a substrate 1 of the medium. The substrate may be colored, if necessary. A magnetic recording layer 2 is formed on the substrate 1 by depositing a magnetic material on the substrate by vacuum deposition or sputtering, or coating a mixture of a magnetic material and a binder resin onto the surface of the substrate and drying. On the magnetic recording layer 2 was formed a metal thin film, thereby forming a light reflection layer 3. Finally, a reversible thermosensitive recording layer 4 is formed on the light reflection layer 3 to obtain the desired information memory and display medium.

Examples of the magnetic material for forming the magnetic recording layer 2 include metals such as iron, cobalt and nickel, and alloys and compounds thereof.

Examples of the binder resin for use with the magentic material for the formation of the magnetic recording layer 2 include various thermoplastic resins, thermosetting resins, ultraviolet-ray-curing resins and electron-ray-curing resins.

The light reflection layer 3 can be formed on the magnetic recording layer 2 by vacuum deposition, ion plating, sputtering or chemical vacuum deposition. Any metals which can reflect light can be used for the formation of this layer; for instance, Al, Ge, Au, Ag, Cu and alloys thereof are usable. It is preferable that the light reflection layer 3 have a thickness of 200 to 1000 Å.

The reversible thermosensitive recording layer 4 is formed on the light reflection layer 3 by the following method (1) or (2):

(1) A solution containing a matrix resin and one or more organic low-molecular-weight compounds, or a dispersion of one or more organic low-molecular-weight compounds in a solution of a matrix resin dissolved in a solvent in which at least one of the organic low-molecular-weight compounds cannot be dissovled is coated onto the surface of the light reflection layer 3, and then dried; or (2) A matrix resin and one or more organic low-molecular-weight compounds are kneaded in the presence or absence of a solvent, if necessary, under application of heat. The resulting mixture is extended to a sheet, and the sheet is provided on the light reflection layer 3.

The solvent for use in the above process is selected out of a variety of solvents depending upon the kind of the matrix resin and that of the low-molecular-weight compounds, and, in general, tetrahydrofuran, methyl ethyl ketone, methyl isobutyl ketone, chloroform, carbon tetrachloride, ethanol, toluene or benzene is preferably employed. Not only in the case where the above-mentioned dispersion is employed, but also in the case of the solution, the one or more organic low-molecular-weight-compounds exist in the form of fine crystals dispersed in the reversible thermosensitive recording layer.

The matrix resin employed in the reversible thermosensitive recording layer not only holds the organic low-molecular-weight compounds in a uniformly dispersed state, but also has a significant effect on the transparency of the reversible thermosensitive recording layer when it is in a miximum transparent state. Therfore, it is preferable that the matrix resin have high mechanical stability and excellent film-forming properties.

The preferable examples of the matrix resin are polyvinyl chloride; vinyl chloride copolymers such as a vinyl chloride - vinyl acetate copolymer, a vinyl chloride - vinyl acetate - vinyl alcohol copolymer, a vinyl chloride - vinyl acetate - maleic acid copolymer and a vinyl chloride - acrylate copolymer; polyvinylidene chloride; vinylidene chloride copolymers such as a vinylidene chloride - vinyl chloride copolymer and a vinylidene chloride - acrylonitrile copolymer; polyester; polyamide; polyacrylate; polymethacrylate; an acrylate - methcarylate copolymer; and a silicone resin. The above resins ma be used either singly or in combination.

The organic low-molecular-weight compound for use in the reversible thermosensitive recording layer is required to change its crystal phase from a polycrystal state to a single crystal state depending upon the temperature of the layer, and those having a melting point of 30° to 200° C., preferably 50° to 150° C., are employed.

Examples of such organic low-molecular-weight compounds include alkanol, alkane diol, halogenoalkanol, halogenoalkane diol, alkylamine, alkane, alkene, alkyne, halogenoalkane, halogenoalkene, halogenoalkyne, cycloalkane, cycloalkene, cycloalkyne, saturated or unsaturated mono or dicarboxylic acid, esters of saturated or unsaturated mono or dicarboxylic acid, amides of saturated or unsaturated mono or dicarboxylic acid, ammonium salts of saturated or unsaturated mono or dicarboxylic acid, saturated or unsaturated halogeno fatty acid, esters of saturated or unsaturated halogeno fatty acid, amides of saturated or unsaturated halogeno fatty acid, ammonium salts of saturated or unsaturated halogeno fatty acid, allylcarboxylic acid, esters of allylcarboxylic acid, amides of allylcarboxylic acid, ammonium salts of allylcarboxylic acid, halogenoallylcarboxylic acid, esters of halogenoallylcarboxylic acid, amides of halogenoallylcarboxylic acid, ammonium salts of halogenoallylcarboxylic acid, thioalcohol, thiocarboxylic acid, esters of thiocarboxylic acid, amides of thiocarboxylic acid, ammonium salts of thiocarboxylic acid, carboxylate of thioalcohol. These compounds are used either singly or in combination.

It is preferable that the above compounds contain carbon atoms of 10 to 60, more preferably 10 to 38, and most preferably 10 to 30. It is acceptable that the above esters contain an alcohol moiety saturated or substituted with a halogen. At any rate, it is preferable that the organic low-molecular-weight compounds contain at least one of oxygen, nitrogen, sulfur and a halogen, such as —OH, —COOH, —CONH, —COOR, —NH, —$NH_2$, —S—, —S—S—, —O—, —F, —Cl, —Br, or —I.

Specific examples of the organic low-molecular-weight compounds are higher fatty acids such as lauric acid, mirystic acid, pentadecanoic acid, palmitic acid, stearic acid, behenic acid, lignoceric acid, nonadecanoic acid, arachic acid and oleic acid; higher fatty acid esters such as methyl stearate, tetradecyl stearate, octadecyl stearate, octadecyl laurate, tetradecyl palmitate and dodecyl behenate; ethers and thioethers such as $C_{16}H_{33}—O—C_{16}H_{33}$, $C_{16}H_{33}—S—C_{16}H_{33}$, $C_{18}H_{37}—S—C_{18}H_{37}$, $C_{12}H_{25}—S—C_{12}H_{25}$, $C_{19}H_{39}—S—C_{19}H_{39}$, $C_{12}H_{25}—S—S—C_{12}H_{25}$,

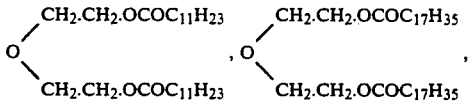

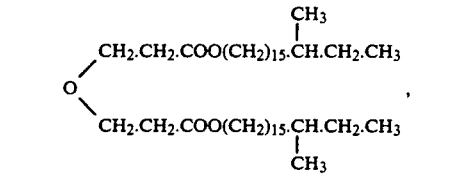

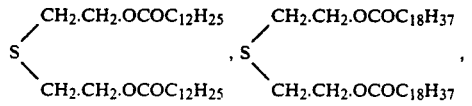

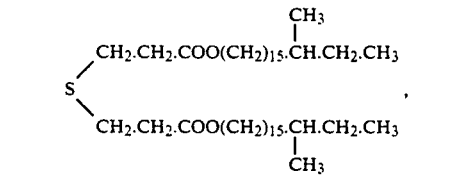

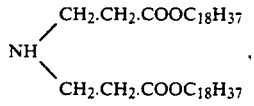

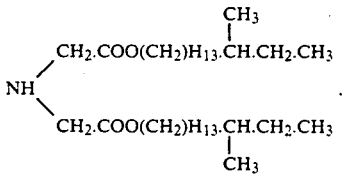

Of the above compounds, higher fatty acids having 16 or more, preferably 16 to 24, of carbon atoms, such as palmitic acid, stearic acid, behenic acid and lignoceric acid, are preferably employed.

It is preferable that the ratio by weight of the total amount of the organic low-molecular-weight compounds to the matrix resin be in the range of 2:1 to 1:16, more preferably in the range of 1:1 to 1:3, when dispersibility of the organic compounds in the matrix resin and the transparency of the reversible thermosensitive recording layer are taken into consideration.

In addition to the above-described components, auxiliary components such as a surface active agent and a solvent having a high boiling point may be incorporated into the reversible thermosensitive recording layer 4 so as to easily obtain a transparent image.

Specific examples of the solvent having a high boiling point are as follows: tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebatate, di-2-ethylhexyl sebatate, diethylene glycol dibenzoate, triethylene glycol di-2-ethylbutylate, methylacetyl ricinoleate, butylacetyl ricinoleate, butylphthalylbutyl glycolate and tributylacetyl citrate.

Specific examples of the surface active agents and other additives are as follows: higher fatty acid esters of polyvalent alcohol; higher alkylethers of polyvalent alcohol; addition products of higher fatty acid esters of polyvalent alcohol, higher alcohols, higher alkylphenols, higher fatty acid higher alkylamines, higer fatty acid amides, oils and fats, and polypropylene glycol with a lower olefin oxide; acetylene glycol; Na, Ca, Ba or Mg salts of higher alkylbenzenesulfonic acids; Ca, Ba or Mg salts of higher fatty acids, aromatic carboxylic acids, higher aliphatic sulfonic acids, aromatic sulfonic acids, sulfuric monoesters, phosphoric monoesters and phosphoric diesters; sulfuric oils; polyalkylacrylate; acrylic oligomers, polyalkylmethacrylate; copolymers of alkylmethacrylate and amine-containing monomer, copolymers of styrene and maleic anhydride, and copolymers of olefin and maleic anhydride.

An overcoat layer 6 may be provided on the surface of the reversible thermosensitive recording layer 4, if necessary. The thickness of the overcoat layer 6 is preferably 0.1 to 4 μm, and can be prepared by using a silicone rubber, a silicone resin as disclosed in Japanese Laid-Open Patent Application 63-221087, a polysiloxane grafted polymer as disclosed in Japanese Laid-Open Patent Application 62-152550, or a ultraviolet-ray- or an electron-ray-curing resin as disclosed in Japanese Laid-Open Patent Application 63-310600. The above material is dissolved in a solvent in which the matrix resin and the low-molecular weight compounds never or hardly be dissolved. The resulting solution is coated onto the surface of the reversible thermosensitive recording layer 4, and then dried.

Examples of such solvents include n-hexane, methyl alcohol, ethyl alcohol and isopropyl alcohol. Of these, an alcohol is preferred from the economical point of view.

In order to protect the reversible thermosensitive recording layer 4 from the solvent contained in the overcoat layer 6, an intermediate layer 5 may be interposed between the reversible thermosensitive recording layer 4 and the overcoat layer 6 as disclosed in Japanese Laid-Open Patent Applicatrion 1-133781.

Examples of the material for the intermediate layer 5 include the following resins: resins usable as the matrix resin of the reversible thermosensitive recording layer 4 as mentioned previously, and thermosetting and thermoplastic resins such as polyethylene, polypropylene, polystyrene, polyvinyl alcohol, polyvinyl butyral, polyurethane, saturated polyester, unsaturated polyester, epoxy resin, phenol resin, polycarbonate, and polyamide.

The thickness of the intermediate layer 5 is preferably 0.1 to 2 μm.

Since the light reflection layer 3 is formed on the magnetic recording layer 2, the information memory and display medium according to the present invention can attain the aimed objects. However, the magnetic recording layer 2 tends to have a rough surface due to the magentic material contained therein. Light is scattered at the rough surface of the magnetic recording layer, so that the contrast of the density of images displayed in the reversible thermosensitive recording layer 4 to that of the background is lowered.

In order to obtain a smooth surface, it may be possible to provide a layer of a thermosetting resin or the like on the surface of the magentic recording layer, followed by smoothing the resin layer. In this case, it is necessary to make the resin layer considerably thick. The thick layer, however, increases the spacing loss when information recorded in the magnetic recording layer.

Calendering of the surface of the magentic recording layer 2 is also acceptable to obtain a smooth surface.

Figure 2A:
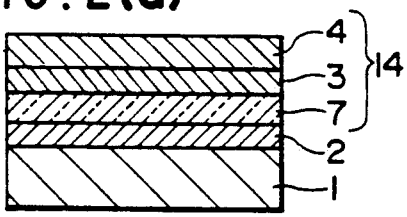
FIGS. 2(*a*), 2(*b*) and 2(*c*) are cross-sectional views of another embodiments of an information memory and display medium according to the present invention.
Figure 2C:
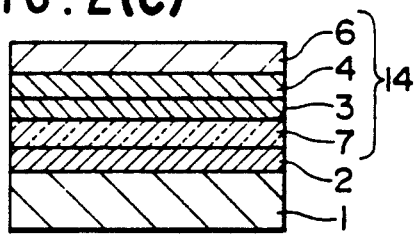
Figure 2B:
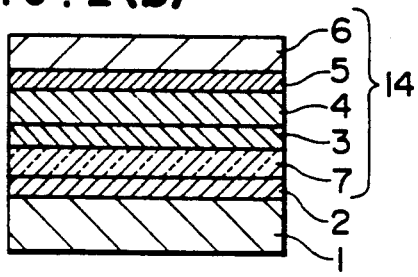

Alternatively, a smoothing layer 7 may be formed on the surface of the magnetic recording layer 2, on which light reflection layer 3 is formed as shown in FIG. 2. The smoothing layer can be formed by using an ultraviolet-ray- or electron-ray-curing monomer or oligomer.

Figure 3A:
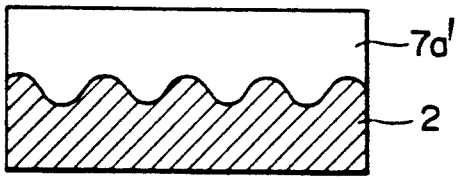
FIGS. 3(*a*), 3(*b*), and 4(*a*) and 4(*b*) are illustrations showing the states of a smoothing layer formed on a magnetic recording layer.
Figure 3B:
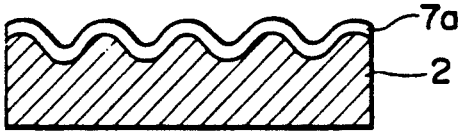

In the case where a polymer resin is employed to form a smoothing layer, it is inevitable to dissolve the resin in a solvent to the extent that the resin can be readily coated onto the surface of the magnetic recording layer 2. The resulting solution, in general, containing 5 to 20 wt. % of the resin is coated onto the surface of the magnetic recording layer 2 as shown in FIG. 3(*a*), in which the smoothing layer before drying is indicated by reference numeral *7a'*. Thereafter, the layer *7a'* is heated to vaporize the solvent, and a resin layer *7a* can be obtained as shown in FIG. 3(*b*). The resin layer *7a* thus obtained is thin, so that it cannot sufficiently conceal the rough surface of the magnetic recording layer. Thus, the above-described method is not suitable for forming a smoothing layer.

Figure 4A:
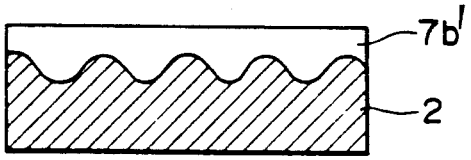
Figure 4B:
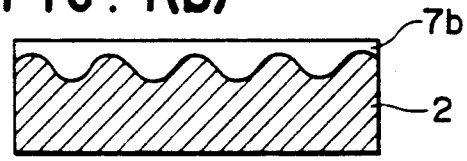

The inventors of the present invention have found that it is quite effective to use monomer or oligomer of an ultraviolet-ray- or electron-ray-curing type for forming a smoothing layer. When it is employed, it is not necessary to dissolve it in a large amount of a solvent, because the viscosity of the monomer or oligomer itself is low. Therefore a layer obtained by coating a solution of the monomer or oligomer in a small amount of a solvent onto the surface of the magnetic recording layer 2 and then dried is relatively thick. The rough surface of the magnetic recording layer can thus be well concealed by the layer, and a smooth surface can be obtained. This is shown in FIGS. 4(*a*) and 4(*b*), in which reference *7b'* denotes a layer of the monomer or oligomer before drying and reference numeral *7b* denotes the layer after drying. Namely, the layer *7b* shown in FIG. 4(*b*) is equal to the smoothing layer 7 shown in FIG. 2.

Examples of the solvents which are usable in the above process are the same as those of the solvents usable in the formation of the reversible thermosensitive recording layer 4. Instead of using the solvent, a photopolymerization initiator can be employed, which serves as a reactive diluent.

Examples of the photopolymerization initiator include 2-ethylhexyl acrylate, cyclohexyl acrylate, buthoxyethyl acrylate, neopentyl glycol diacrylate, 1,6-hexanediol diacrylate, polyethylene glycol diacrylate, trimethylolpropane triacrylate, and pentaerythritol triacrylate.

Any monomers and oligomers which are polymerized by application of an ultraviolet ray and hardened to be resins can be used for the formation of the smoothing layer 7. Examples of such monomers and oligomers include (poly)esteracrylate, (poly)urethaneacrylate, epoxyacrylate, polybutadineacrylate, siliconeacrylate and melamineacrylate.

(Poly)esteracrylate is a reaction product of a polyvalent alcohol such as 1,6-hexanediol, propylene glycol or diethylene glycol, a polybasic acid such as adipic acid, phthalic anhydride or trimellitic acid, and an acrylic acid. The following (a), (b) and (c) are specific examples of the (poly)esteracrylate.

(a) Reaction product of adipic acid, 1,6-hexanediol and acrylic acid, having the following formula:

$$CH_2{=}CHCOO{\leftarrow}CH_2{\rightarrow}_5[O{-}CO{-}(CH_2{\rightarrow}_4COO{\leftarrow}CH_2{\rightarrow}_5]_nOCOCH{=}CH_2$$

wherein n is an integer of 1 to 15.

(b) Reaction product of phthalic anhydride, propylene oxide and acrylic acid, having the following formula:

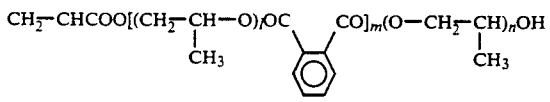

wherein l, m and n are respectively an integer of 1 to 15.

(c) Reaction product of trimellitic acid, diethylene glycol and acrylic acid, having the following formula:

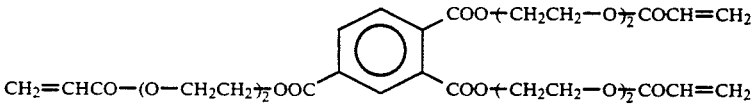

(Poly)urethaneacrylate can be obtained by reacting a compound having an isocyanate group such as tolylene diisocyanate (TDI) with acrylate having a hydroxyl group. The following (d) is an example of the (poly)urethaneacrylate.

(d) Reaction product of 2-hydroxyethyl acrylate, tolylene diisocyanate (TDI), 1,6-hexanediol (HDO) and adipic acid (ADA), having the following formula:

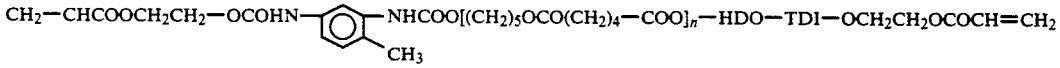

wherein n is an integer of 1 to 10.

Epoxyacrylate can be roughly classified into three types, a bisphenol A type, a novolac type and an alicyclic type, and each type of epoxyacrylate can be obtained by esterifying an epoxy group contained in an epoxy resin of the corresponding type with acrylic acid to make an acryloyl group. The following (e), (f) and (g) are examples of the epoxyacrylate.

(e) Bisphenol A type epoxyacrylate, obtained by reacting a bisphenol A-epichlorohydrin type epoxy resin with acrylic acid, having the following formula:

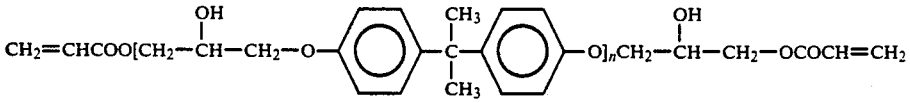

wherein n is an integer of 1 to 15.

(f) Novolac type epoxyacrylate, obtained by reacting a phenol novolac-epichlorohydrin type epoxy resin with acrylic acid, having the following formula:

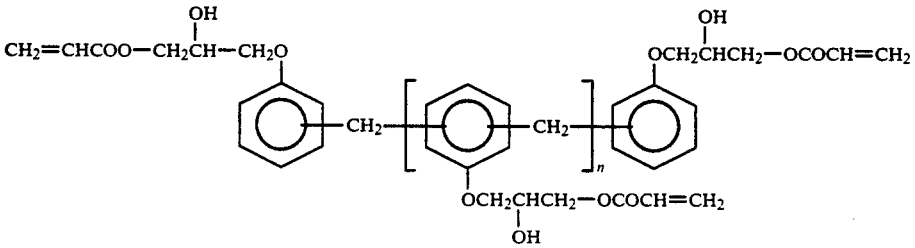

wherein n is zero or integer of 1 to 5.

(g) Alicyclic type epoxyacrylate, obtained by reacting a alicyclic type epoxy resin with acrylic acid, having the following formula:

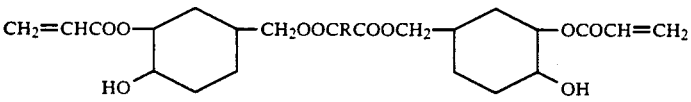

wherein R is a chain of 1 to 10 carbon atoms.

Polybutadieneacrylate is obtained by reacting 1,2-polybutadiene having an OH group at its terminal end with isocyanate or 2-mercaptoethanol, followed by reaction with acrylic acid. The following (h) is an example of the polybutadieneacrylate.

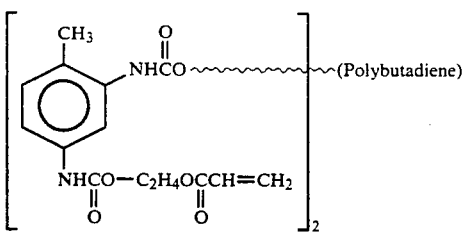

(h)

Siliconeacrylate can be obtained, for example, by condensation polymerization of an organofunctional trimethoxy silane and polysiloxane having a silanol group. The following (i) is an example of the silicon acrylate is as follows:

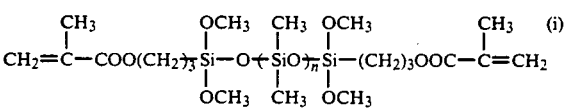

(i)

wherein n is an integer of 10 to 14.

The above-described monomers and oligomers can also be cured by application of an electron ray.

An electron ray has permeability stronger than that of an ultraviolet ray. Therefore, when a smoothing layer 7 contains, in particular, a pigment, the electron ray can reach deeper portion of the layer than the ultraviolet ray. The layer cured by the electron ray can thus have a more fine and homogeneous net-work structure than the layer cured by the ultraviolet ray. Furthermore, since the energy of the electron ray is three times stronger than that of the ultraviolet ray, the production cost can be reduced even if high plant and equipment investment is required.

The thickness of the smoothing layer 7 is preferably 0.2 to 3.0 μm when the smoothing effect and the spacing loss at the time of recording information in the magnetic recording layer are taken into consideration.

Other features of this invention will become apparent in the course of the following description of exemplary embodiments, which are given for illustration of the invention and are not intended to be limiting thereof.

EXAMPLE 1

An information memory and display medium of the type shown in FIG. 1 (c) according to the present invention was prepared by the following procedure.

A solution having the following formulation was coated onto the surface of a white PET film with a thickness of approximately 188 μm, which serves as a substrate 1, by a wire bar, and dried under application of heat to form a magnetic recording layer 2 with a thickness of approximately 10 μm.

| <Formulation of Solution for Magnetic Recording Layer> | parts by weight |
|---|---|
| $\gamma$-$Fe_2O_3$ | 10 |
| Copolymer of vinyl chloride, vinyl acetate and vinyl alcohol (Trademark "VAGH", made by UCC Corp.) | 2 |
| 10% toluene solution of isocyante (Trademark "Coronate L", made by Nippon Polyurethane Industry Co., Ltd.) | 2 |
| Methyl ethyl ketone | 43 |
| Toluene | 43 |

The surface of the magnetic recording layer 2 was smoothed by calendering. Aluminum was vacuum-deposited on the smoothed surface to form a light reflection layer 3 with a thickness of approximately 400 Å.

A solution having the following formulation was coated onto the surface of the light reflection layer 3, and then dried under application of heat to form a reversible thermosensitive recording layer 4 with a thickness of approximately 2 μm.

| <Formulation of Solution for Reversible Thermosensitive Recording Layer> | parts by weight |
|---|---|
| Behenic acid | 8 |
| Hexadecanedioic acid | 2 |
| Di(2-ethylhexyl)phthalate | 2 |
| Copolymer of vinyl chloride, vinyl acetate and phosphate (Trademark "Denka Vinyl #1000P", made by Denki Kagaku Kogyo, K.K.) | 20 |
| Tetrahydrofuran | 150 |
| Toluene | 10 |

A solution having the following formulation was coated onto the surface of the reversible thermosensitive recording layer 4 by a wire bar, and dried under application of heat to form an intermediate layer 5 with a thickness of approximately 0.5 μm.

| <Formulation of Solution for Intermediate Layer> | parts by weight |
|---|---|
| Polyamide resin (Trademark "CM8000", made by Toray Industries, Inc.) | 10 |
| Methyl alcohol | 90 |

A butylacetate solution of an ultraviolet-ray-curing oligomer of an urethaneacrylate type (Trademark "UNIDIC 17-824-9", made by Dainippon Ink & Chemicals, Inc.) was coated onto the surface of the intermediate layer 5 by a wire bar, and dried under application of heat. To the dried layer was applied an ultraviolet ray for 5 seconds by an ultraviolet lump of 80 W/cm, thereby forming an overcoat layer 6 with a thickness of approximately 2 μm.

Thus, information memory and display medium No. 1 according to the present invention was prepared.

EXAMPLE 2

The procedure in Example 1 was repeated except that the solution used for forming the reversible thermosensitive recording layer 4 was replaced by a solution having the following formulation, the thickness of the thermosensitive recording layer was changed from 2 μm to approximately 5 μm, and the ultraviolet-curing oligomer of an urethaneacrylate type used for forming the overcoat layer 6 was replaced by an ultraviolet-curing oligomer of an epoxyacrylate type (Trademark "UNIDIC C7-127", made by Dainippon Ink & Chemicals, Inc.), whereby information memory and display medium No. 2 according to the present invention was prepared.

| <Formulation of Solution for Reversible Thermosensitive Recording Layer> | parts by weight |
|---|---|
| Stearic acid | 7 |
| Stearyl stearate | 3 |
| Di-n-butylphthalate | 2 |
| Copolymer of vinyl chloride, vinyl acetate and maleic acid (Trademark "VMCH", made by UCC Corp.) | 2 |
| Tetrahydrofuran | 150 |

EXAMPLE 3

The procedure in Example 1 was repeated except that the thickness of the reversible thermosensitive recording layer 4 was changed from 2 μm to approximately 8 μm, whereby information memory and display medium No. 3 according to the present invention was prepared.

EXAMPLE 4

The procedure in Example 1 was repeated except that the thickness of the reversible thermosensitive recording layer 4 was changed from 2 μm to approximately 10 μm, whereby information memory and display medium No. 4 according to the present invention was prepared.

EXAMPLE 5

An information memory and display medium of the type shown in FIG. 2(*a*) according to the present invention was prepared by the following procedure.

A solution having the following formulation was coated onto the surface of a white PET film with a thickness of approximately 188 μm, which serves as a substrate 1, by a wire bar, and dried under application of heat to form a magnetic recording layer 2 with a thickness of approximately 10 μm.

| <Formulation of Solution for Magnetic Recording Layer> | parts by weight |
|---|---|
| $\gamma$-$Fe_2O_3$ | 10 |
| Copolymer of vinyl chloride, vinyl acetate and vinyl alcohol (Trademark "VAGH", made by UCC Corp.) | 10 |
| 50% toluene solution of isocyanate (Trademark "Coronate L", made by Nippon Polyurethane Industry Co., Ltd.) | 2 |
| Methyl ethyl ketone | 40 |
| Toluene | 40 |

A solution having the following formulation was coated onto the surface of the magnetic recording layer 2 by a wire bar, and dried under application of heat. To the dried layer was applied an ultraviolet ray for 5 seconds by an ultraviolet lump of 80 W/cm, thereby forming a smoothing layer 7 with a thickness of approximately 0.7 μm.

| <Formulation of Solution for Smoothing Layer> | parts by weight |
|---|---|
| 49% butylacetate solution of ultraviolet-ray-curing oligomer of an acrylic type (Trademark "UNIDIC C7-164", made by Dainippon Ink & Chemicals, Inc.) | 10 |
| Toluene | 4 |

Aluminum was vacuum-deposited on the surface of the smoothing layer 7 to form a light reflection layer 3 with a thickness of approximately 400 Å.

A solution having the following formulation was coated onto the surface of the light reflection layer 3, and then dried under application of heat to form a reversible thermosensitive recording layer 4 with a thickness of approximately 5 μm.

<Formulation of Solution for Reversible Thermosensitive Recording Layer>

| | parts by weight |
|---|---|
| Behenic acid | 8 |
| Eicosanedioic acid | 2 |
| Diallylphthalate | 2 |
| Copolymer of vinyl chloride, vinyl acetate and phosphate (Trademark "Denka Vinyl #1000P", made by Denki Kagaku Kogyo, K.K.) | 20 |
| Tetrahydrofuran | 200 |

Thus, information memory and display medium No. 5 according to the present invention was prepared.

EXAMPLE 6

The procedure in Example 5 was repeated except that the thickness of the smoothing layer 7 was changed from 0.7 μm to approximately 1.5 μm, whereby information memory and display medium No. 6 according to the present invention was prepared.

EXAMPLE 7

The procedure in Example 5 was repeated except that the thickness of the smoothing layer 7 was changed from 0.7 μm to approximately 3.0 μm, whereby information memory and display medium No. 7 according to the present invention was prepared.

EXAMPLE 8

The procedure in Example 5 was repeated except that the ultraviolet-ray-curing oligomer of an acrylic type used for the formation of the smoothing layer 7 was replaced by an ultraviolet-ray-curing oligomer of an epoxyacrylate type (Trademark "UNIDIC C7-157", made by Dainippon Ink & Chemicals, Inc.), and the thickness of the smoothing layer 6 was changed from 0.7 μm to approximately 1.5 μm, whereby information memory and display medium No. 8 according to the present invention was prepared.

EXAMPLE 9

The procedure in Example 6 was repeated except that the ultraviolet ray applied for forming the smoothing layer 7 was replaced by an electron ray of 300 keV, whereby information memory and display medium No. 9 according to the present invention was prepared.

COMPARATIVE EXAMPLE 1

The procedure in Example 1 was repeated except that the thickness of the reversible thermosensitive recording layer 4 was changed from 2 μm to approximately 1 μm, whereby comparative information memory and display medium No. 1 was prepared.

COMPARATIVE EXAMPLE 2

The procedure in Example 3 was repeated except that the light reflection layer 3 formed in Example 3 was eliminated, whereby comparative information memory and display medium No. 2 was prepared.

The above-prepared information memory and display media Nos. 1 to 9 according to the present invention and comparative media Nos. 1 and 2 were evaluated by the following method.

Information memory and display media Nos. 1 and 3 according to the present invention were heated to a temperature of 80° C., media Nos. 2 and 4 according to the present invention and comparative media Nos. 1 and 2 were heated to 60° C., and media Nos. 5, 6, 7, 8 and 9 according to the present invention were heated to 75° C. to make the reversible thermosentive recording layer of each medium transparent.

Thereafter, heat with a thermal energy of 1 mJ/dot was respectively applied to media Nos. 1, 2 and 3 according to the present invention and comparative media Nos. 1 and 2, and heat with a thermal energy of 0.5 mJ/dot was respectively applied to media Nos. 4 to 9 according to the present invention by a thermal head to obtain white opaque images in each of the thermosensitive recording layer.

The density of the images obtained and that of the background were measured by the conventional method, and the contrast which is the ratio of the density of the background to that of the images was obtained by calculation. The results are shown in the table below.

Furthermore, the spacing loss of each of the above-mentioned information memory and display media was measured in accordance with the previously mentioned method. The results are shown in the table shown below.

TABLE

| Medium | Density of Images | Density of Background | Contrast | Spacing Loss (%) |
|---|---|---|---|---|
| No. 1 | 0.48 | 1.75 | 3.6 | 95 |
| No. 2 | 0.30 | 1.50 | 5.0 | 90 |
| No. 3 | 0.20 | 1.36 | 6.8 | 83 |
| No. 4 | 0.18 | 1.30 | 7.2 | 62 |
| No. 5 | 0.34 | 1.10 | 3.2 | 92 |
| No. 6 | 0.35 | 1.50 | 4.3 | 90 |
| No. 7 | 0.37 | 1.88 | 5.1 | 87 |
| No. 8 | 0.36 | 1.60 | 4.4 | 91 |
| No. 9 | 0.35 | 1.55 | 4.4 | 90 |
| Comp. No. 1 | 0.82 | 1.87 | 2.3 | 97 |
| Comp. No. 2 | 1.26 | 1.90 | 1.5 | 84 |

What is claimed is:

1. An information memory and display medium comprising:

(a) a support, (b) a magnetic recording layer formed on said support, (c) a thermosensitive recording layer formed on said magnetic recording layer, which comprises (i) a light reflection layer formed on said magnetic recording layer, and (ii) a reversible thermosensitive recording layer formed on said light reflection layer, comprising a matrix resin, and one or more organic low-molecular-weight compounds dispersed in said matrix resin, with the transparency thereof being reversibly changeable between a transparent state and an opaque state depending upon the temperature thereof, thereby capable of yielding thermally erasable images.

2. The information memory and display medium as claimed in claim 1, wherein said thermosensitive recording layer further comprises an overcoat layer on said reversible thermosensitive recording layer.

3. The information memory and display medium as claimed in claim 2, wherein said thermosensitive recording layer further comprises an intermediate layer which is interposed between said reversible thermosensitive recording layer and said overcoat layer.

4. The information memory and display medium as claimed in claim 1, wherein said thermosensitive recording layer further comprises a smoothing layer comprising an ultraviolet-ray- or electron-ray-cured resin, which is interposed between said magnetic recording layer and said light reflection layer.

5. The information memory and display medium as claimed in claim 4, wherein said thermosensitive recording layer further comprises an overcoat layer on said reversible thermosensitive recording layer.

6. The information memory and display medium as claimed in claim 5, wherein said thermosensitive recording layer further comprises an intermediate layer which is interposed between said reversible thermosensitive recording layer and said overcoat layer.

7. The information memory and display medium as claimed in claim 4, wherein said smoothing layer has a thickness ranging from 0.2 μm to 3.0 μm.

8. The information memory and display medium as claimed in claim 1, wherein said thermosensitive recording layer has a thickness ranging from more than 2 μm to not more than about 15 μm, and said reversible thermosensitive recording layer has a thickness ranging from 2 μm to less than 15 μm.

9. The information memory and display medium as claimed in claim 8, wherein said reversible thermosensitive recording layer has a thickness ranging from 2 μm to 10 μm.

* * * * *

UNITED STATES PATENT AND TRADEMARK OFFICE

CERTIFICATE OF CORRECTION

PATENT NO. : 5,260,254

DATED : November 9, 1993

INVENTOR(S) : Yoshihiko Hotta et al

It is certified that error appears in the above-indentified patent and that said Letters Patent is hereby corrected as shown below:

Column 4, line 49, "truns to" should read --turns to--.

Column 6, line 6, "a miximum" should read --a maximum--.

Column 8, line 34, "hardly be" should read --hardly are--.

Column 8, line 46, "Patent Applicatrion" should read --Patent Application--.

Column 9, line 7, "information recorded" should read --information is recorded--.

Column 13, line 47, "ultraviolet lump" should read --ultraviolet lamp--.

UNITED STATES PATENT AND TRADEMARK OFFICE

CERTIFICATE OF CORRECTION

PATENT NO. : 5,260,254

DATED : November 9, 1993

INVENTOR(S) : Yoshihiko Hotta et al

It is certified that error appears in the above-indentified patent and that said Letters Patent is hereby corrected as shown below:

Column 14, line 56, "ultraviolet lump" should read --ultraviolet lamp--.

Signed and Sealed this

Twenty-seventh Day of December, 1994

Bruce Lehman

*Attest:*

BRUCE LEHMAN

*Attesting Officer*

*Commissioner of Patents and Trademarks*